United States Patent [19]

Schöttle

[11] 4,358,997

[45] Nov. 16, 1982

[54] ADDRESS PRINTING MACHINE

[75] Inventor: Helmut A. M. Schöttle, Berlin, Fed. Rep. of Germany

[73] Assignee: Pitney Bowes Deutschland GmbH, Fed. Rep. of Germany

[21] Appl. No.: 281,146

[22] Filed: Jul. 7, 1981

Related U.S. Application Data

[63] Continuation of Ser. No. 82,518, Oct. 9, 1979, abandoned.

[30] Foreign Application Priority Data

Oct. 6, 1978 [DE] Fed. Rep. of Germany ..... 2843750

[51] Int. Cl.[3] ..... B41F 1/06

[52] U.S. Cl. ..... 101/316; 101/318; 101/324; 101/336

[58] Field of Search ..... 101/287, 292, 316, 318, 101/324, 336, 297

[56] References Cited

U.S. PATENT DOCUMENTS

| | | | |
|---|---|---|---|
| 2,207,144 | 7/1940 | Cooper | 101/287 |
| 2,496,598 | 2/1950 | Rast | 101/287 |
| 2,626,565 | 1/1953 | Schuster | 101/287 |
| 3,379,129 | 4/1968 | Harrison | 101/316 |
| 3,589,279 | 6/1971 | Deutsch | 101/287 X |
| 3,601,047 | 8/1971 | Waibel | 101/287 X |
| 4,029,010 | 6/1977 | Deisting | 101/316 |
| 4,121,520 | 10/1978 | Sherohn | 101/318 |

FOREIGN PATENT DOCUMENTS 1388482 3/1975 United Kingdom .

*Primary Examiner*—Edward M. Coven
*Attorney, Agent, or Firm*—Peter Vrahotes; Albert Scribner; William Soltow, Jr.

[57] ABSTRACT

The invention relates to an address printing machine having a flat printing pad, a printing anvil, and two driving systems. The printing anvil serves as a support for a data carrier with raised characters and for a printing assembly having at least one sheet of paper and an interspaced ink transferring ribbon (carbon paper). One of the driving systems serves to move the printing pad or printing anvil into the operating position, with a minimum of power and the other driving system subsequently causes an electromagnetic impulse printing device to exert a very short impression impulse to achieve the ink transfer with a minimum of movement.

23 Claims, 12 Drawing Figures

ADDRESS PRINTING MACHINE

This is a continuation of application Ser. No. 082,518, filed Oct. 9, 1979, now abandoned.

BACKGROUND OF THE INVENTION

A known address printing machine of the type using embossed data carriers is described in German Pat. No. 24 57 114. Complicated driving mechanisms are used for moving the printing pad and the printing anvil into the operating position; i.e. there is provided either a toggle joint system, which absorbs the forces of impression when in an extended position, or a cam (rotating wedge) wich also causes the printing pad and the printing anvil to approach each other along an axis which is perpendicular to the printing pad or printing anvil plane, the cam acting against the force of a spring. Although this rotating wedge will ensure self-locking of the driving mechanism over a sufficient range, and thereby will accommodate various thicknesses of the printing assemblies in a relatively small range, this will be possible only in a complex and expensive structure.

It should be mentioned here, that from a small printing device of another type which primarily serves for imprinting with a credit card, see U.S. Pat. No. 4,085,675, it is already known to provide the central frame of the machine with a swivel arm, which however, comprises a printing roller which is caused by a drive motor to roll across the printing assembly when the swivel arm is in its lowered position. An electromagnetically operating locking mechanism is located between the central frame and the swivel arm the locking force of which decreases inversely proportional to the square of the thickness of the printing assembly.

SUMMARY OF THE INVENTION

It is therefore an object of the invention to improve the aforementioned address printing machine so that the above-given disadvantages of the known devices can be overcome and an especially simple structural device will be achieved, which, particularly, will be suitable to be used as a small printer and which ensures high qualitive impressions irrespective of the thickness of the printing assembly.

The address printing machine according to this invention which solves this problem is particularly characterized in that a swivel arm is hinged to the central frame of the machine, a printing pad is mounted on one of two parts, and a printing anvil with the electromagnetic impulse printing device, wich serves to exert the impression impulse, is arranged at the other part. A locking mechanism is arranged between the two parts which, when the printing pad and the printing anvil approach one another, serves to fix the distance between each other depending on the thickness of the printing assembly immediately before the impression impulse is triggered.

After lowering the swivel arm onto the printing assembly, irrespective of the respective thickness of the printing assembly, the locking mechanism will ensure that the distance will not be increased during the following actuation of the impression impulse, i.e. the printing assembly cannot cause the printing pad and the printing anvil to be removed from each other before or during the printing operation, i.e. it cannot cause the swivel arm to be moved upwards. Moreover, an essentially increased lifting distance can be attained so that the printing position can be completely exposed in order to easily insert the forms and printing device.

It has been found suitable, both structurally as well as functionally, to provide an embodiment which is characterized in that the swivel arm is actuated through an impression impulse triggering handle mounted on the swivel arm and operatively connected to the locking mechanism to act against the effect of a spring and with which a control switch is associated, which switch controls the circuit of the impulse printing device.

Thus, in order to automatically achieve the desired locking effect immediately before the impression impulse is initiated, only the swivel arm has to be lowered onto the printing assembly because of the impression impulse triggering handle.

Generally, the desired result can be simply achieved since the locking mechanism comprises two locking members, a locking pin and a spring loaded locking cam, one of which is connected to the swivel arm and the other one to the central frame. Both members are shaped and arranged in a manner so that when the lowering movement of the swivel arm onto the printing assembly, which is interposed between the printing pad and the printing anvil, is finished, the locking cam interlocks the locking pin, thereby fixing the lower position. Thus, the locking cam could be located on a movable shiftable member. Structurally, however, it has been found to be especially appropriate to mount the locking cam on a locking lever which is rockable against the force of a spring acting on it, when the swivel arm is unloaded, to release the locking pin. Herein the locking pin extends from the swivel arm parallel to its swivel axis and the locking lever is pivotally mounted at the central frame around a shaft extending parallel to the above swivel axis. This can be achieved advantageously in a very simple manner when the locking cam is formed by one of the boundary edges of a groove which is tapered in the direction to its base and arranged in the locking lever.

In a particularly suitable embodiment, the locking lever is associated with an unlocking lever which is under the effect of a spring and acts on the locking lever to release a locking pin when the swivel arm is unloaded. The unlocking lever can be coupled to the impression impulse triggering handle. In lieu of this, when a motor is used to lower the swivel arm down to the printing assembly, in a very advantageous manner it would be possible to cause the locking lever to be returned into the unlocking position by the motor itself. Appropriately, for this purpose, a cam disc can be mounted on the shaft driven by the motor which serves to return the locking lever into the unlocking position and which cooperates with a shoulder of the locking lever, which shoulder extends into the path of the cam disc.

It has been found to be very advantageous for address printing machines in general, but particularly an address printing machine of the type having a pivoting printing pad mounted at a swivel arm which is pivotally mounted at a central frame of the machine provided with a printing anvil of an electromagnetic impulse printing device, to provide an aperture for receiving the parts of an ink ribbon box, that has spools, at each side of the printing pad as well as at each side of the printing anvil of the impulse printing device. Thus, when a great number of pieces of such machines is to be manufactured, most of the same structural members can be used irrespective of the fact whether the machines are to be used for achieving impressions from printing devices which have been "positively" embossed (i.e. embossed so that the raised characters are on the "reading" side) or "negatively" embossed (i.e. embossed so that the intaglio characters are on the "reading" side).

It should be mentioned that, obviously, the term "address printing machine" means any small printer by means of which impressions can be achieved by printing devices which are analogous to address printing devices, including small printers used to achieve impressions from credit cards.

Other details, advantageous and characteristics of the invention will become apparent from the following description and by reference to the accompanying drawings which by way of illustration show preferred embodiments.

BRIEF DESCRIPTION OF THE DRAWINGS

FIG. 3 is a partial cross-sectional view of an address printing machine as shown in FIG. 1 provided with a motor drive;

DETAILED DESCRIPTION OF THE PREFERRED EMBODIMENT

Figure 1:
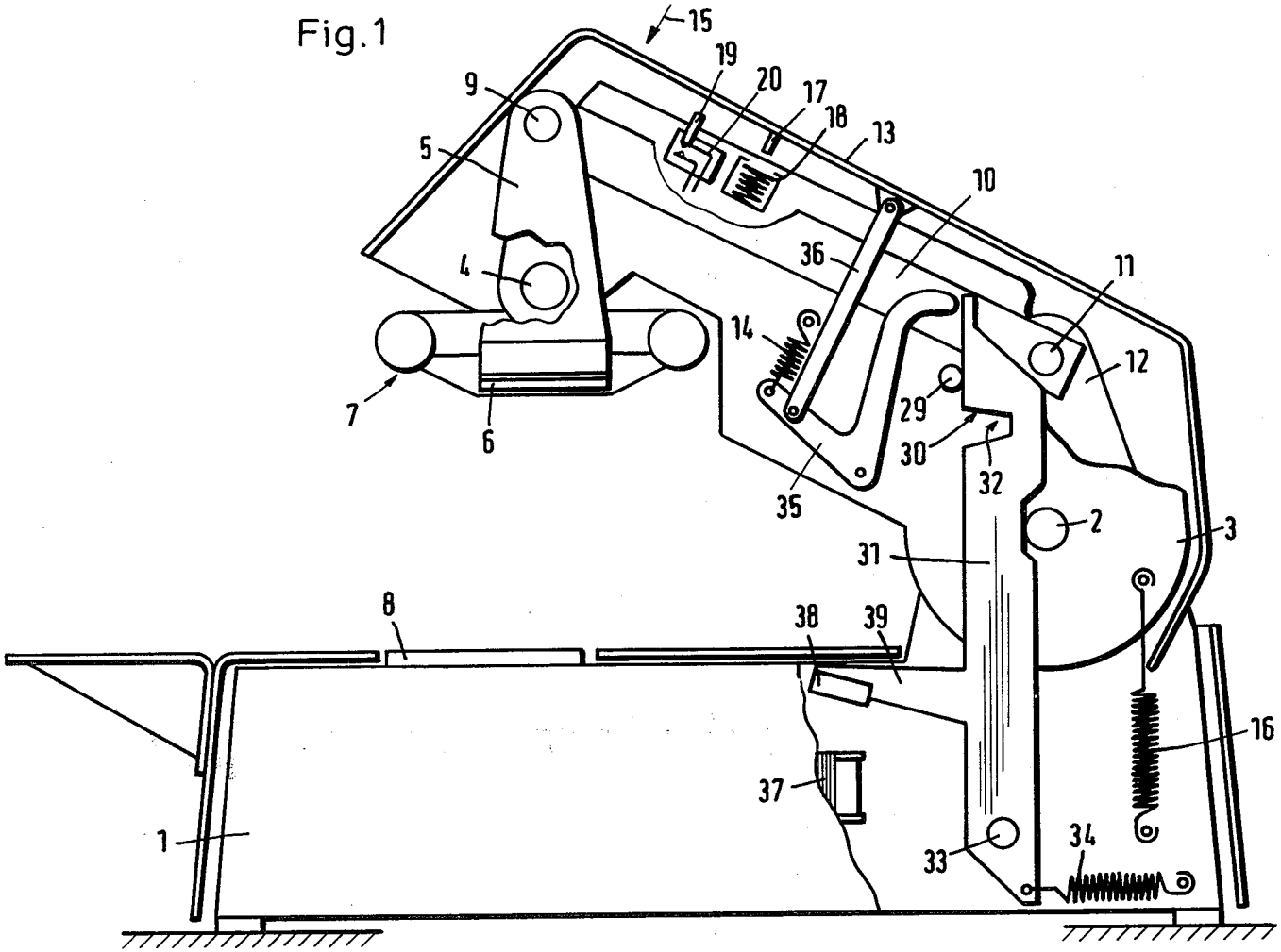
FIG. 1 is a longitudinal cross-sectional side view of an address printing machine that incorporates the principles of the instant invention, shown in its rest position.
Figure 2:
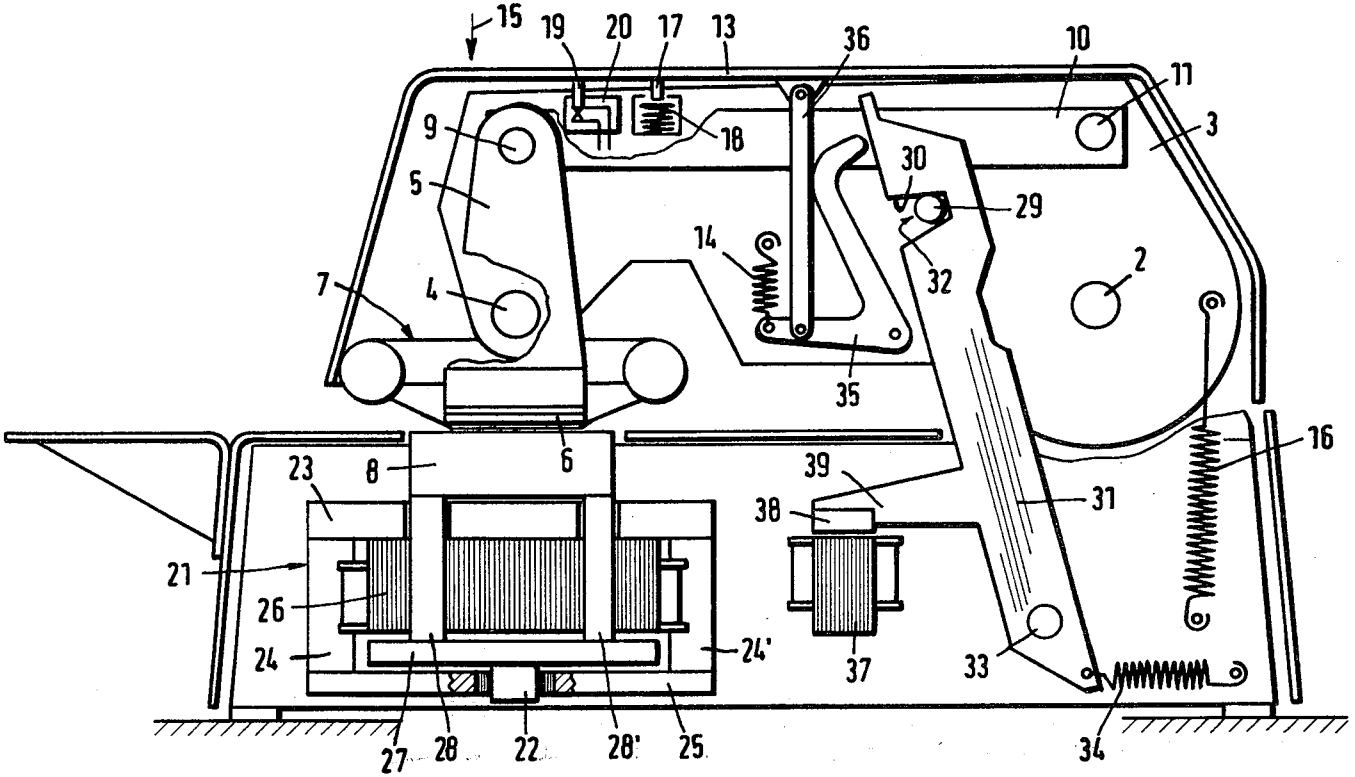
Figure 3:
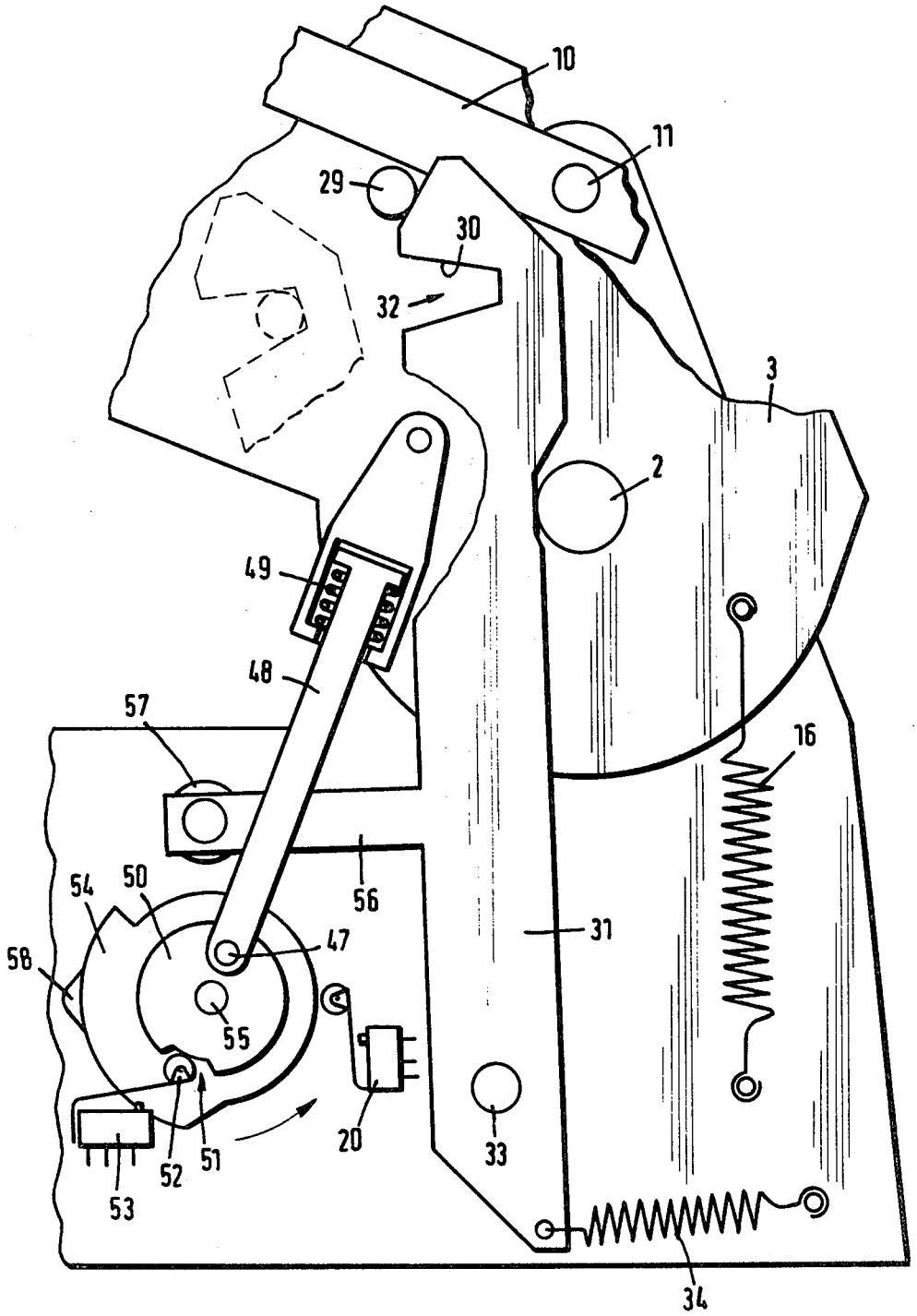
FIG. 3 is a longitudinal cross-sectional side view of the address printing machine of FIG. 1 shown in its printing or operating position.

Referring now to the drawings, particularly to FIGS. 1 to 3, a central frame 1 of the illustrated address printing machine has a shaft 2 about which a swivel arm 3 is pivotally or rotatively mounted to swivel thereabout. At the front end of the swivel arm 3 is a shaft 4 upon which a printing pad holding device 5 with a printing pad 6 and an associated ink ribbon box 7 is pivotally mounted.

As can be seen from the drawing, a parallel guiding device is associated with the printing pad holding device 5 in order to ensure parallelism with the printing anvil 8, positioned in the central frame 1, when the printing pad 6 is lowered thereupon, as well as in the case when printing assemblies having various thicknesses will be used. This parallel guiding device includes a connecting bar 10 which is hinged to a shoulder 12 of the central frame 1 of the machine through shaft 11, and through a shaft 9 mounted on the holding device 5, which shaft 9 extends over the printing pad shaft 4.

Figure 7:
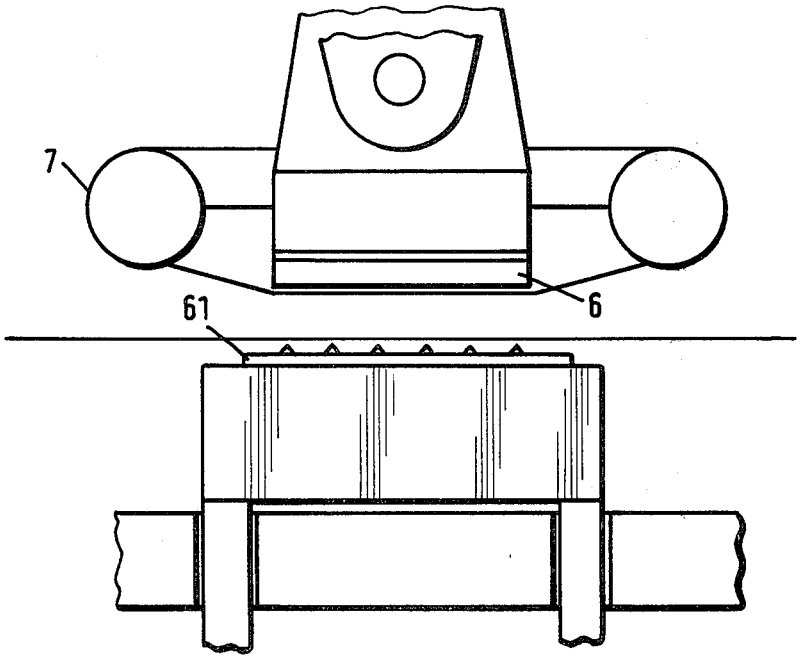
FIG. 7 is a view similar to FIG. 6 but with a different ink ribbon box.

The address printing machine according to FIGS. 1, 2 and 7, in which the ink ribbon box 7 is associated with the printing pad 6, is suitable for achieving impressions from address printing plates having "positively" embossed characters, i.e. the side with the raised portions in the "reading" side. Herein the address printing plate will be positioned on the printing anvil 8 having the side with the raised portions exposed and upon which a printing assembly 63 to be printed is laid.

In the illustrated embodiment according to the FIGS. 1 and 2 an impression impulse triggering handle, shaped as a cover 13 covering the swivel arm 3, is associated with said swivel arm 3 and, in the manner of a lever, pivotally is mounted around the shaft 2 of the swivel arm 3. This cover 13 is at rest when it is spaced relative to the swivel arm 3 a given distance and of course under the effect of a spring 14, the task of which will be explained in more detail later on. When the cover 13 is depressed in the direction of the arrow 15, initially the cover 13 will approach the swivel arm 3 tensioning a spring 14. Subsequently, the swivel arm 3 is guided away tensioning a spring 16, which is interposed between the swivel arm 3 and the central frame 1, until, finally, the printing pad 6 will contact a printing assembly (not shown in the FIGS. 1 and 2) positioned on the printing anvil 8. When the cover 13 furthermore approaches the swivel arm 3, finally, a lug 17 provided at the inner side of the cover 13 engages a pre-stressed spring 18, mounted within the swivel arm 3. After the initial tension of this spring 18 has been overcome, a control switch 20 will be closed by a push rod 19 and, thereby, the impression impulse of an impulse printing device 21, mounted below the printing anvil 8, is enabled.

The impulse printing device 21 includes, in a manner as described in German Pat. No. 24 57 114, a middle support 22 which extends downwardly from the printing anvil 8 and is mounted in a traverse support 23 as well as within a cover plate 25 that is connected to the traverse support 23 through vertical supports 24, 24' so as to be movable up and down. The traverse support 23 which is fixed to the central frame 1 is fixedly connected to an electromagnet 26 which is associated with an armature plate 27 located above the cover plate 25. This armature plate 27 is connected to the printing anvil 8 through four connected rods 28 to 28''', only two of which 28, 28' are shown in the FIG. 2. When the electromagnet 26 is energized by closing the control switch 20, the printing anvil 8 together with the armature plate 27 can perform a lifting movement in the range of 0.3 . . . 0.5 mm in order, in this way, to exert an impression impulse on a printing assembly 63, which is kept in close contact to the printing anvil 8 under the printing pad 6.

When the cover 13 and, therewith, the swivel arm 3 are released by the operator, at first the spring 18 and, subsequently, as the swivel arm 3 is moving upwardly, the springs 14 and 16 are released from tension.

In order to ensure that during triggering of the impression impulse that the distance between the printing pad 6 and the printing anvil 8 will not be increased, according to the invention, a locking mechanism is provided. This locking mechanism comprises, essentially, at least one locking pin 29 and at least one locking cam 30 which are operatively connected to the swivel arm 3 and the central frame 1, respectively, in such a manner that after completing the lowering movement of the swivel arm 3 down onto the printing assembly, which is interposed between printing pad 6 and the printing anvil 8, the locking cam 39 interlocks the locking pin 29 fixing the low position of the swivel arm 3. The locking cam 30 is formed in a locking lever 31 by one of the boundary edges of a lateral groove 32 of the locking lever 31. Said groove 32 is tapered along the edge closest to the central frame 1. The locking pin 29 projects from the swivel arm 3 parallel to the swivel shaft 2. The locking lever 31 is pivotally mounted to the central frame 1 by a shaft 33, which shaft extends parallel to the shaft 2 of the swivel arm 3 and is under the influence of the force of a frame supported spring 34 acting on its lower end which tends to force it against the locking pin 29.

Based on the tapered shape of the lateral groove 32 of the locking lever 31, i.e., because of the slight inclination of the boundary edge which forms the locking cam 30, the locking pin 29 slides along this boundary edge during the locking operation. The thinner the printing assembly positioned on the printing anvil 8 the more the locking lever 31 will be rocked. In the case where a thicker printing assembly is used, the locking pin 29 will only partially enter the groove 32 of the locking lever 31, i.e., it will already be at rest at the outer portion of the boundary edge.

As it is apparent from the drawing an unlocking lever 35 is associated with the locking lever 31. The aforementioned spring 14 acts on the unlocking lever 35 which is pivotally mounted on the swivel arm 3 and coupled to the cover 13, forming the impression impulse triggering handle, through a connecting rod 36.

The spring 34 which acts on the locking lever 31 is dimensioned, relative to the spring 14 acting on the unlocking lever 35, in such a manner that the spring 14 not only will cause the cover 13 through the connecting rod 36 to return to its rest position as shown in the FIG. 1, but, simultaneously, will cause the locking lever 31 to return into its unlocked position, thereby tensioning the spring 34 acting on it.

In order to increase the force of locking during the printing operation a holding magnet 37 is associated with the locking lever 31 and is attached to the central frame 1 of the housing. An armature plate 38 of the holding magnet 37 is mounted upon a lateral arm 39 of the locking lever 31.

Figure 4:
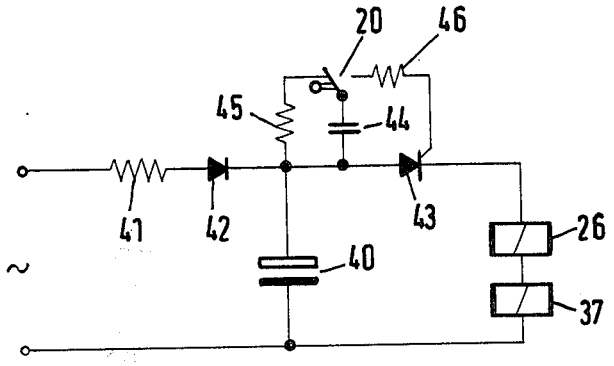
FIG. 4 is a circuit diagram which illustrates the arrangement and mode of operation of the electrical elements in the embodiment according to the FIGS. 1 and 2.

As it is apparent from the circuit diagram according to FIG. 4, the electromagnet 26 is arranged in a discharging circuit comprising a storage capacitor 40 and the control switch 20. The holding magnet 37 is in series with the electromagnet 26 of the impulse printing device. Thus, it is ensured that exactly during the period of the printing operation the force of locking will be increased. In order to charge the storage capacitor 40 a limiting resistor 41 and a rectifier 42 are provided in the series with it. The storage capacitor 40 will not be discharged directly through the contacts of the control switch 20 but rather through a thyristor 43 interposed in the discharging circuit and which is followed by the ignition circuit comprising the control switch 20, the ignition capacitor 44, and both the limiting resistors 45, 46.

Whereas an embodiment is illustrated in FIGS. 1 and 2 wherein the movement of the swivel arm 3 brought about by pressing a hand on the cover 13, FIG. 3 illustrates an embodiment provided with a crank assembly comprising a crank pin 47, which is arranged eccentrically to a motor driven shaft 55, in order to move the swivel arm 3. The crank pin 47 is connected to the swivel arm 3 through a tie rod 48. The tie rod 48 consists of two parts between which a balancing spring 49 is interposed for accomodating different thicknesses of the printing assembly. A compression of the balancing spring 49 causes an extension of the tie rod 48 occasioned by a greater thickness of an interposed printing assembly.

The crank pin 47 is positioned on a disc 50 provided with a notch 51 into which a feeler 52 of a switch 53 interlocks when the swivel arm 3 is in its rest position. When the switch 53 is closed, it will enable a motor 60 for driving the shaft 55. As soon as the rotation of the disc 50 with the crank pin 47 has been completed, the feeler 52 again is received within the notch 51 of the disc 50, so that the switch 53 opens the circuit.

A cam disc 54 is arranged on the shaft 55 coaxially with the disc 50 and serves, in cooperation with a lateral arm 56 bearing a roll 57, for returning the locking lever 31 out of the locking position and into its unlocking position as soon as the printing operation has been finished.

In order to initiate the impression impulse by the impulse printing device in this embodiment an actuating cam 58 rotates with the shaft 55 to engage the control switch 20. This actuating cam 58 actuates the impression impulse after the crank pin 47 has completed half its cycle upon which the crank assembly will be in its bottom dead center.

Figure 5:
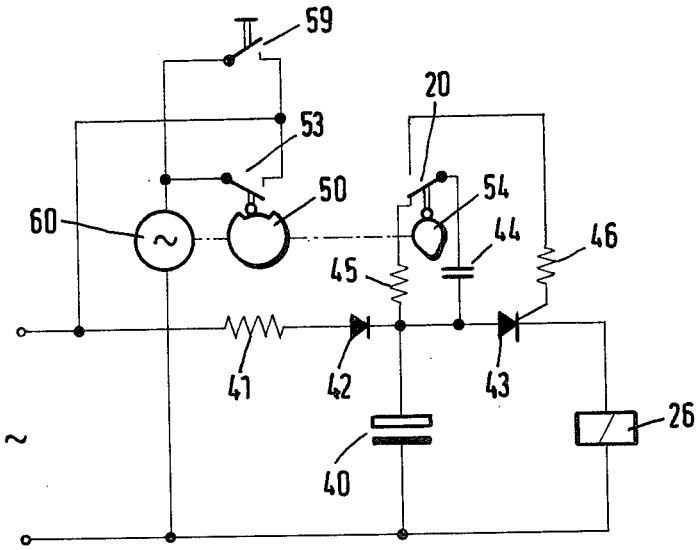
FIG. 5 is a circuit diagram which illustrates the arrangement and mode of operation of the electrical elements in the embodiment according to FIG. 3.

The circuit diagram for the circuit elements of the embodiment according to FIG. 3 is illustrated in the FIG. 5. When an actuator 59, or a respective feeler operable by the printing assembly, is actuated, the motor 60 is started. The switch 53 which is closed by the disc 50 enables the driving motor 60 during a complete revolution after the actuator 59 has been opened. In this embodiment the control switch 20 is operated by the cam disc 54. The rest the circuit elements of the circuit according to the FIG. 5 correspond to those elements according to FIG. 4. Though FIG. 5 shows an embodiment in which an additional holding magnet for the locking lever 31 is not shown, of course, it also will be possible to provide this embodiment with such a holding magnet in the case where it will be used for printing assemblies with a greater range of thicknesses.

Figure 6:
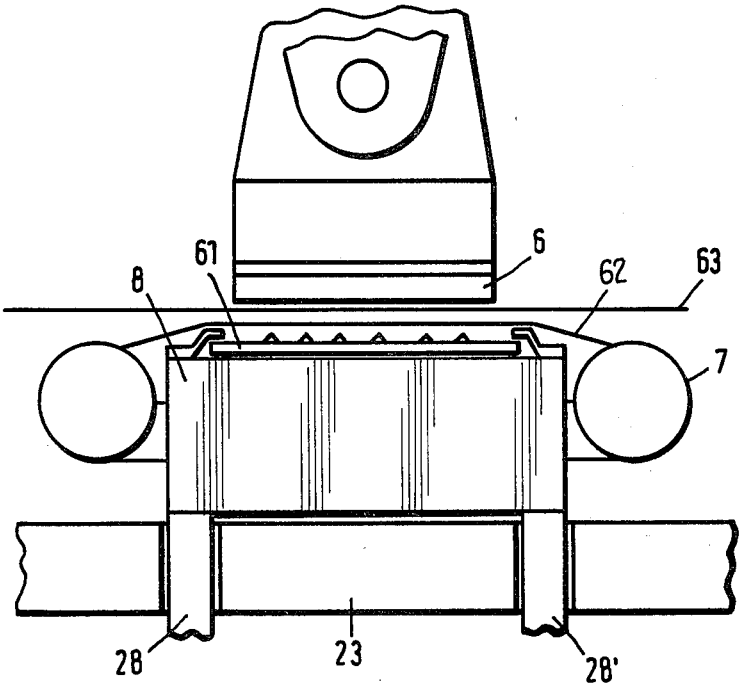
FIG. 6 is an enlarged cross-sectional view of the print head of the address printing machine.

As is shown in FIGS. 6 and 7 it is possible to associate either the printing pad 6 or the printing anvil 8 with the ink ribbon box 7 and to mount this at the printing pad holding device 5 or the printing anvil. Moreover, aperatures for receiving the parts of the ink ribbon box 7, which include opposed spools, are provided at both the sides of the printing pad 6 as well as at both the sides of the printing anvil 8. Upon this constructive, standardization of the manufacture of the address printing machine according to the invention can be realized. As will be apparent from FIG. 6, the "negatively" embossed printing devices 61 in which intaglio parts can be read, will be placed with its side having the raised portions on the top under the ink ribbon box 62 and the printing assembly 63 is put onto the ink ribbon 62. In FIG. 7 the embodiment already shown in FIGS. 1 and 2 is illustrated in a larger scale. In this embodiment, the impression will be performed by means of a "positively" embossed printing device, which raised portions can be read.

Figure 8:
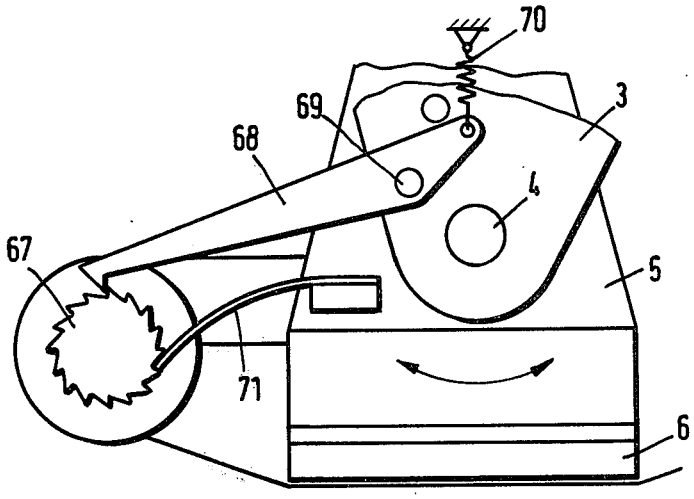
FIG. 8 is a cross-sectional view of the ink ribbon driving device used in the machine shown in FIGS. 1 to 3.
Figure 9:
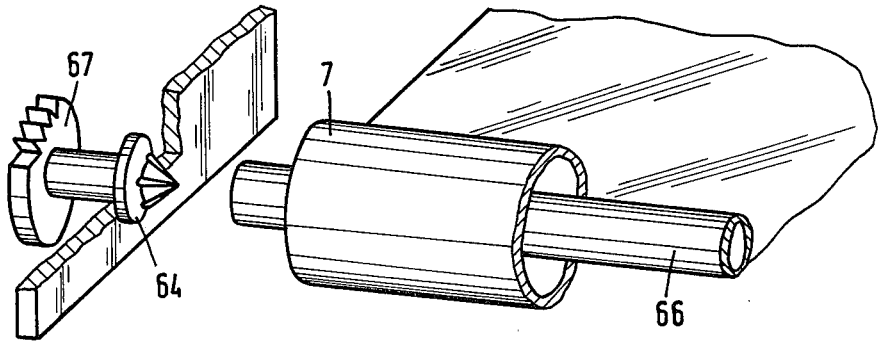
FIG. 9 is a perspective view of a portion of the ink ribbon driving device shown in FIG. 8.
Figure 10:
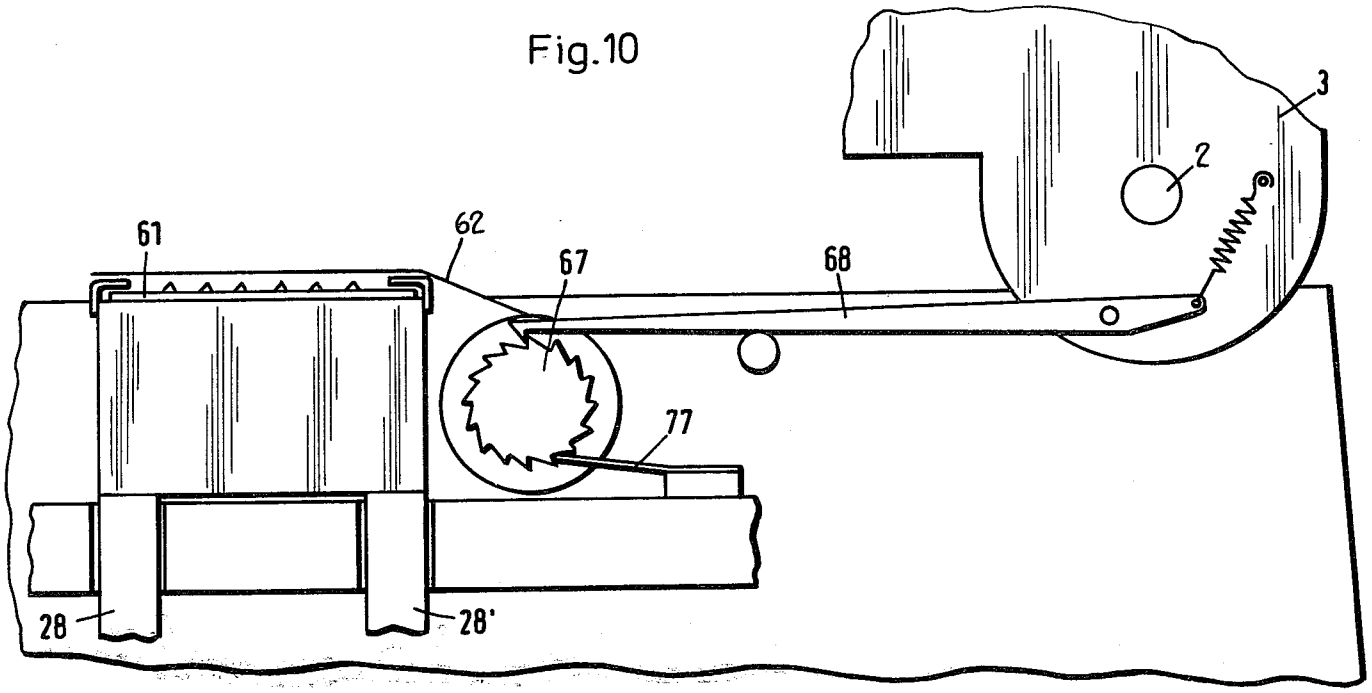
FIG. 10 is a cross-sectional view of the ink ribbon driving mechanism of the machine shown in FIGS. 1 to 3 showing the printing anvil mounted at the central frame of the machine.
Figure 11:
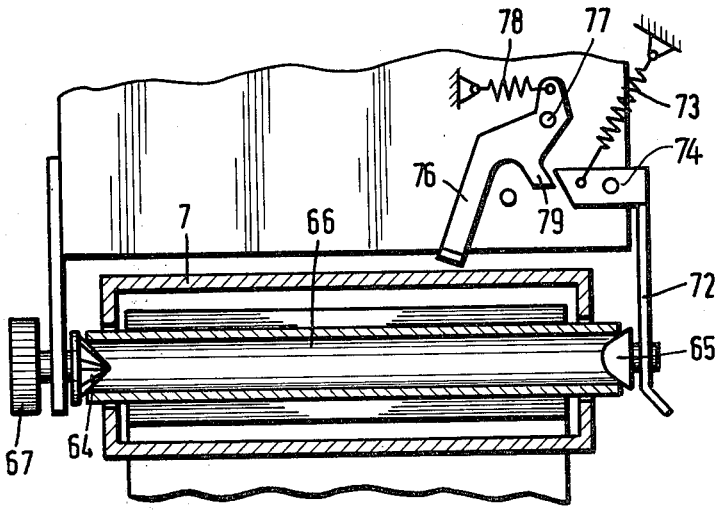
FIGS. 11 and 12 show the holding and clamping device for the spools of the ink ribbon box in different respective positions.
Figure 12:
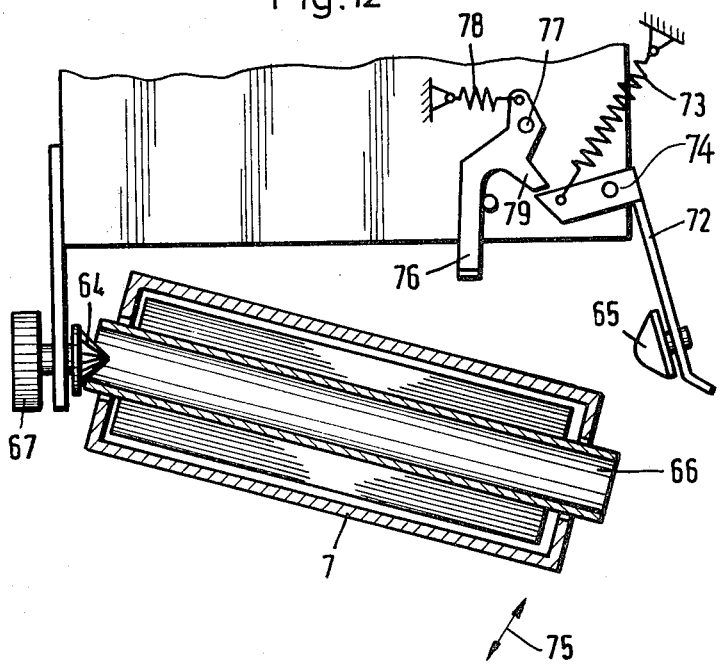

Referring now to the FIGS. 11 and 12, supporting pins 64 and 65 extend into the apertures which are provided at both the sides of the printing pad 6 or the printing anvil 8 of the impulse printing device 21, supporting pins 64 and 65 extend to which the ink ribbon box 7 can be attached by its spools, or, more exactly, with its spool lug 66. It can be seen from the drawing, at least one supporting pin 64 is formed as a driver to be coupled with the spool lug 66 which then serves as the winding spool. The driver pin 64 is connected to a ratchet wheel 67 of an ink ribbon shifting device that includes a pawl 68 which cooperates with the ratchet wheel 67 and performs one forward-and-backward movement during each printing cycle. The pawl 68 is hinged to the swivel arm 3 in the case the ink ribbon box 7 will be supported by the printing pad 6 as well as in the case the ink ribbon box will be supported by the printing anvil 8. In the first case it will be hinged directly adjacent the shaft 4 (compare FIG. 8) and in the latter case it will be hinged directly adjacent the shaft 2 (compare FIG. 10).

The outer end of each pawl 68 which swivels around a shaft 69 on the swivel arm 3 under the influence of the force of a spring 70 which urges the pawl 68 into engagement with the associated ratchet wheel 67. Additionally a back locking spring 71 engages the ratchet wheel 67 in order to prevent a rotation of the ratchet wheel in the backward direction.

In order to allow the ink ribbon box 7 to be attached to the supporting pins 64, 65, one of the respective pins, preferably the driver 64, is stationary while the other one 65 is arranged on a pivotable abutment 72 which is under the influence of a force of a spring 73. This spring 73 tends to swivel the abutment 72 together with the supporting pin 65 around a pin 74. This swiveling movement towards the spool lug 66 will be possible only if the ink ribbon box 7 is attached to the driver supporting pin 64 and swiveled upwards as indicated by the arrow 75. At that moment, namely the ink ribbon box 7 abuts a rocker lever 76 which pivots around a pin 77 against the influence of the force of a spring 78 acting on it. A supporting arm 79 connected to said rocker lever 76 releases the abutment 72 when the rocker lever 76 is rocked away thereby releasing the tension in the spring 73 so that the supporting pin 65 engages the spool lug 66 and clamps and positions the box as it is illustrated in FIG. 11.

What is claimed is:

1. An address printing machine comprising: a central frame, a swivel arm pivotally mounted to said central frame, a printing pad mounted on said swivel arm, a printing anvil mounted on said central frame and slidable in a direction toward and away from said printing pad, said printing pad being movable toward and away from said printing anvil upon the pivoting of said swivel arm, an electromagnetic impulse printing device supported by said central frame and connected to said printing anvil to move said printing anvil toward said printing pad when enabled, a locking mechanism connected between said swivel arm and said central frame, said locking mechanism including a locking pin connected to said swivel arm and a locking lever having a groove pivotally connected to said central frame, said locking pin being receivable within said groove when said swivel arm is pivoted to move said printing pad toward said printing anvil to interlock said locking pin within said locking lever groove so as to define the locking position of said locking mechanism and the printing position of said printing pad, and an unlocking lever pivotally mounted on said swivel arm and engageable with said locking lever, first spring means connected to said swivel arm and said unlocking lever, said first spring means urging said unlocking lever against said locking lever to urge said locking lever away from said locking pin upon said swivel arm being pivoted to move said printing pad away from its printing position, and means for enabling said electromagnetic impulse printing device after said printing pad has been placed in its printing position to move said printing anvil toward and into contact with printing pad.

2. Address printing machine according to claim 1, including an impression impulse triggering handle movably connected to said swivel arm, second spring means located between said handle and said swivel arm for biasing said handle and swivel arm away from one another wherein said means for enabling said electromagnetic impulse printing device is a control switch located intermediate said handle and said swivel arm, said control switch being in electrical connection with said electromagnetic impulse printing device, the electromagnetic impulse printing device being enabled when said second spring means is overcome upon said handle being moved toward said swivel arm to engage said control switch.

3. Address printing machine according to claim 2, wherein said locking pin projects from said swivel arm parallel to the axis of rotation of said swivel arm and said locking lever is rotatably mounted on a shaft on said central frame to swivel about an axis extending parallel to said swivel arm axis.

4. Address printing machine according to claim 3 wherein a locking cam is formed by one of the boundary edges of said groove which is tapered on the side closest to said central frame.

5. Address printing machine according to claim 2 wherein said unlocking lever is coupled to said impression impulse triggering handle.

6. Address printing machine according to claim 5 wherein a connecting rod is hinged at one end to the impression impulse triggering handle and at its other end to the unlocking lever to move said unlocking lever away from said locking lever when said handle is moved toward said swivel arm and a third spring means is connected to said central frame and said locking lever to urge said locking lever toward said locking pin.

7. Address printing machine according to claim 6 wherein said first spring means acting on said unlocking lever is stronger than said third spring means acting on said locking lever, such that said locking lever is urged away from said locking pin by said unlocking lever when said second spring means biases the impulse triggering handle away from said swivel arm.

8. Address printing machine according to claim 2 wherein said impression impulse triggering handle is a lever which extends above said swivel arm and is connected to said swivel arm by a shaft supported by said central frame and about which said impression impulse triggering handle and said swivel arm rotate.

9. Address printing machine according to claim 2 including a holding magnet comprising an armature plate fixed to said locking lever and an electro-magnet mounted on said central frame whereby the force of locking during the printing operation is increased when said holding magnet is enabled.

10. Address printing machine according to claim 1, including a crank assembly connected to said swivel arm and to said central frame of the machine and means for operating said crank assembly to drive said swivel arm towards and away from said central frame.

11. Address printing machine according to claim 10 wherein said crank assembly comprises a cam disc, a crank pin eccentrically mounted on said disc and a tie rod having one end pivotably connected to the crank pin and its other end being pivotably connected to said swivel arm, said tie rod being formed of two parts with a balancing spring interposed between said parts.

12. Address printing machine according to claim 11 wherein said means for operating said crank assembly includes a motor having a drive shaft, said cam disc being mounted on said motor drive shaft and having a projection which is engageable with said locking lever to return said locking lever to an unlocked position.

13. Address printing machine according to claim 12, wherein said locking lever is provided with a lateral arm having a roll thereon that is in engagement with said disc.

14. Address printing machine according to claim 13 wherein an actuating cam is connected to the motor drive shaft and a control switch is in electrical connection with the circuit of the impulse printing device, said control switch being in engagement with said actuating cam.

15. Address printing machine according to claim 1 including a parallel guiding means connected with the printing pad whereby parallelism is maintained relative to the printing anvil as said printing pad moves toward said printing anvil.

16. Address printing machine according to claim 15, including a connecting bar hinged to said central frame, said printing pad being pivotally mounted on said swivel arm and pivotally connected to said connecting bar to be pivotal about an axis which extends parallel to the axis of rotation of said swivel arm.

17. Address printing machine according to claim 1 wherein opposite sides of said printing pad and opposite sides of said printing anvil each has an aperture arranged to receive the spools of an ink ribbon box.

18. Address printing machine according to claim 17, including at least one supporting pin that extends into the apertures which are arranged at said opposite sides of one of said printing pad or said printing anvil for supporting the spools of an ink ribbon box.

19. Address printing machine according to claim 18, wherein at least one of said supporting pins which is received within the said apertures is a driver that is operative to be coupled to a winding spool lug of an ink ribbon box.

20. Address printing machine according to claim 19, wherein said driver is receivable within a ratchet wheel of an ink ribbon shifting device and a pawl is hinged to said swivel arm and engages said ratchet wheel to perform one forward-and-backward movement during each printing cycle.

21. Address printing machine according to claim 20 wherein each of said supporting pins is receivable within one of said spool lugs, one of said pins being mounted pivotally on a spring loaded abutment.

22. Address printing machine according to claim 21, including a supporting arm connectably engageable with said abutment, said supporting arm preventing said abutment from being engageable with an ink ribbon box inserted between opposed supporting pins.

23. Address printing machine according to claim 22 wherein said supporting arm is connected to a rocker lever which is pivotally supported upon said swivel arm and engageable by an ink ribbon box during insertion of said ink ribbon box between said pins thereby contacting said supporting arm to urge it from engagement with said abutment.

* * * * *